US007766605B2

(12) United States Patent
Lindskog

(10) Patent No.: US 7,766,605 B2
(45) Date of Patent: Aug. 3, 2010

(54) CENTRIFUGAL PUMP

(75) Inventor: Martin Lindskog, Nacka (SE)

(73) Assignee: ITT Manufacturing Enterprises Inc., Wilmington, DE (US)

( * ) Notice: Subject to any disclaimer, the term of this patent is extended or adjusted under 35 U.S.C. 154(b) by 861 days.

(21) Appl. No.: 10/576,322

(22) PCT Filed: Oct. 20, 2004

(86) PCT No.: PCT/SE2004/001503

§ 371 (c)(1),
(2), (4) Date: Jan. 25, 2007

(87) PCT Pub. No.: WO2005/038260

PCT Pub. Date: Apr. 28, 2005

(65) Prior Publication Data

US 2007/0274820 A1 Nov. 29, 2007

(30) Foreign Application Priority Data

Oct. 20, 2003 (SE) ..... 0302752

(51) Int. Cl.
*F04D 29/08* (2006.01)

(52) U.S. Cl. ..... 415/58.3; 415/168.3; 415/172.1

(58) Field of Classification Search ..... 415/121.1, 415/121.2, 58.3, 58.2, 172.1, 174.5, 224, 415/168.3
See application file for complete search history.

(56) References Cited

U.S. PATENT DOCUMENTS

| | | | |
|---|---|---|---|
| 1,634,317 A | 7/1927 | Benson | |
| 3,620,642 A | 11/1971 | Studebaker | |
| 4,349,322 A | 9/1982 | Stahle | |
| 5,516,261 A | 5/1996 | Zelder | |
| 5,984,629 A | 11/1999 | Brodersen et al. | |

FOREIGN PATENT DOCUMENTS

| | | | |
|---|---|---|---|
| EP | 0395604 A1 | | 10/1990 |
| EP | 1 284 368 B1 | | 2/2003 |
| JP | 49-45401 | * | 4/1974 |
| JP | 53001301 A | * | 1/1978 |
| JP | 57153999 | | 9/1982 |
| JP | 64073 | | 2/1994 |
| JP | 4945401 | | 4/1994 |
| JP | 09004585 A | * | 1/1997 |

OTHER PUBLICATIONS

Japanese Office Action dated Oct. 14, 2009 for corresponding Japanese application No. 2006-535315.

* cited by examiner

*Primary Examiner*—Richard Edgar
(74) *Attorney, Agent, or Firm*—Browdy and Neimark, PLLC

(57) ABSTRACT

The present invention relates to a centrifugal pump for pumping of liquids containing pollutions mainly in the form of solid particles, which pump comprises a drive unit, a hydraulic unit, whereby the hydraulic unit comprises a pump housing (20) and a pump impeller (12) rotationally arranged inside the housing, the pump impeller comprising an upper (14) and a lower (16) cover disc and a number of intermediate vanes (18). The invention is characterised in that a bottom wall (22) of the pump housing, having a central inlet opening (24), is arranged with at least one spirally extending back flow affecting means (32, 34) on the side facing the lower cover disc extending parts of or full turns around the inlet opening.

4 Claims, 4 Drawing Sheets

CENTRIFUGAL PUMP

TECHNICAL FIELD

Figure 1:
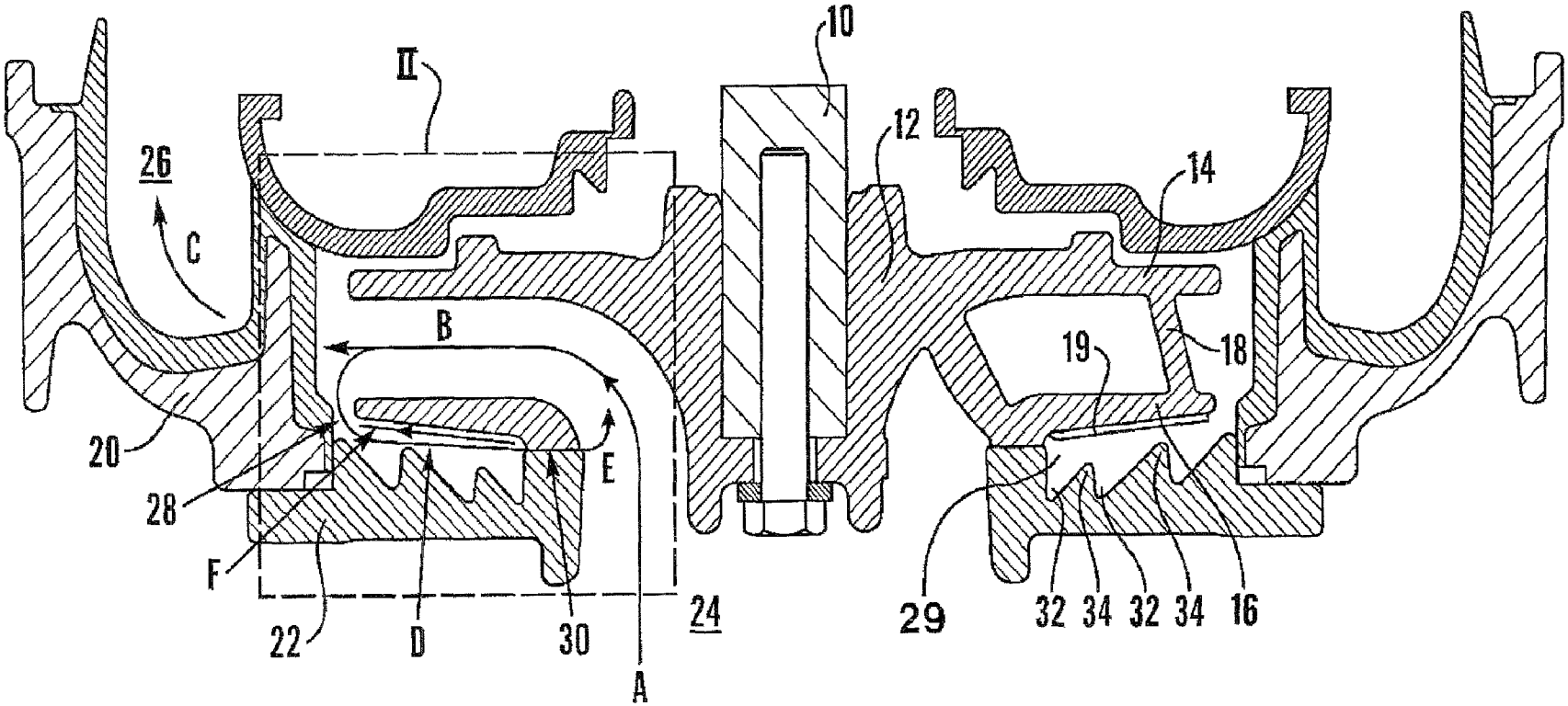

The present invention relates to a pump of a rotodynamical type comprising at least one impeller arranged in a pump housing driven by an electrical motor.

BACKGROUND OF THE INVENTION

Pumps of the above mentioned kind can roughly be divided into two types: centrifugal pumps and axial pumps.

The centrifugal pump comprises an impeller consisting of a hub and at least one cover disc with a number of vanes arranged to the hub, a so called open impeller. A so called closed impeller is arranged with two cover discs with vanes between. The liquid is in both cases sucked in axial direction in the centre of the impeller and leaves the impeller at the periphery in mainly tangential direction.

The axial pump differs from the above mentioned centrifugal pump in that the liquid leaves the pump mainly in axial direction. This deflection is done with the aid of a number of guide rails arranged downstream in the pump housing. The guide rails normally also serves as supporting elements in the construction of the pump housing.

During pumping of polluted liquids such as waste water, water in mines, at construction sites etc, the pumping is often disturbed by the pollution. This may cause clogging of pump impellers and pump housings and also often lead to considerable wear problem.

During pumping of waste water that may contain elongated objects such as rags, there are several methods for solving the problem. An open pump impeller with only one cover disc is then preferred, but even so external measures are required. One may be to run the pump impeller backwards at certain intervals. Another is to arrange some sort of cutting means in front of the intake. U.S. Pat. No. 5,516,261 discloses an open pump impeller for pumping of waste water where the bottom of the pump housing is arranged with a spirally shaped groove, which leads pollutants out towards the periphery where they can cause less damage.

During pumping where high lifting heights are required, for example in mines, closed pump impellers are used, i.e. such with two cover discs, an upper and a lower as well as intermediate vanes. Such impellers have generally speaking higher efficiency than open impellers at high pressure heights. On the other hand, closed impellers have a lesser lead-through, which means higher risk for clogging.

The pollution that is present during pumping in mines often contain elements of highly abrasive material, implying that the material in both pump impeller and pump housing are exposed to great stress. These problems can partly be solved by special surface treatment or hardening of the different components, but it is naturally a desire to ensure that the abrasive particles leave the pump housing as fast as possible in order to avoid unnecessary wear. Further, the geometrical design of the parts that are important for the pumping function of central importance in order to reduce the wear.

BRIEF DESCRIPTION OF THE INVENTION

The aim of the present invention is to achieve a solution of the wear problem by a certain design of the bottom of the pump housing.

According to a main aspect of the invention the aim is solved by a device according to claim 1.

Advantageous features of the invention are the subject of the dependent claims.

According to a main aspect of the invention it is characterized by a centrifugal pump for pumping of liquids containing pollutions mainly in the form of solid particles, which pump comprises a drive unit, a hydraulic unit, whereby the hydraulic unit comprises a pump housing and a pump impeller rotationally arranged inside the housing, the pump impeller comprising an upper and a lower cover disc and a number of intermediate vanes, wherein a bottom wall of the pump housing, having a central inlet opening, is arranged with at least one spirally extending back flow affecting means on the side facing the lower cover disc, extending parts of or full turns around the inlet opening.

The back flow extending means could be arranged as grooves and/or ridges in the bottom wall.

Further, a wall part of the back flow affecting means facing towards the inlet forms an angle with the plane of the bottom wall which preferably should be in the range 85 to 95 degrees.

The back flow affecting means according to the invention acts to affect the back flow, containing pollutions, entering the space between the impeller and the bottom wall so that the pollutions, such as abrasive particles, to a great extent are prevented from reaching the gap, or the amount at least greatly reduced. Most of the particles will enter the grooves or space between the ridges and due to the spiral shape, the particles will be transported to the periphery of the bottom plate, and out through the outlet.

It has been found that the distance between the top surface of the ridges or plateau between the grooves and the lower cover disc should be in the indicated range. A too large distance will not create the desired effect, and a too narrow gap will increase the speed of the back flow, deteriorating the effect.

It has also shown that a rather steep back surface creates an increased effect, possibly creating an increased disturbance on the back flow.

These and other aspects of, and advantages with, the present invention will become apparent from the following detailed description and from the accompanying drawings.

DETAILED DESCRIPTION OF THE DRAWINGS

Figure 2:
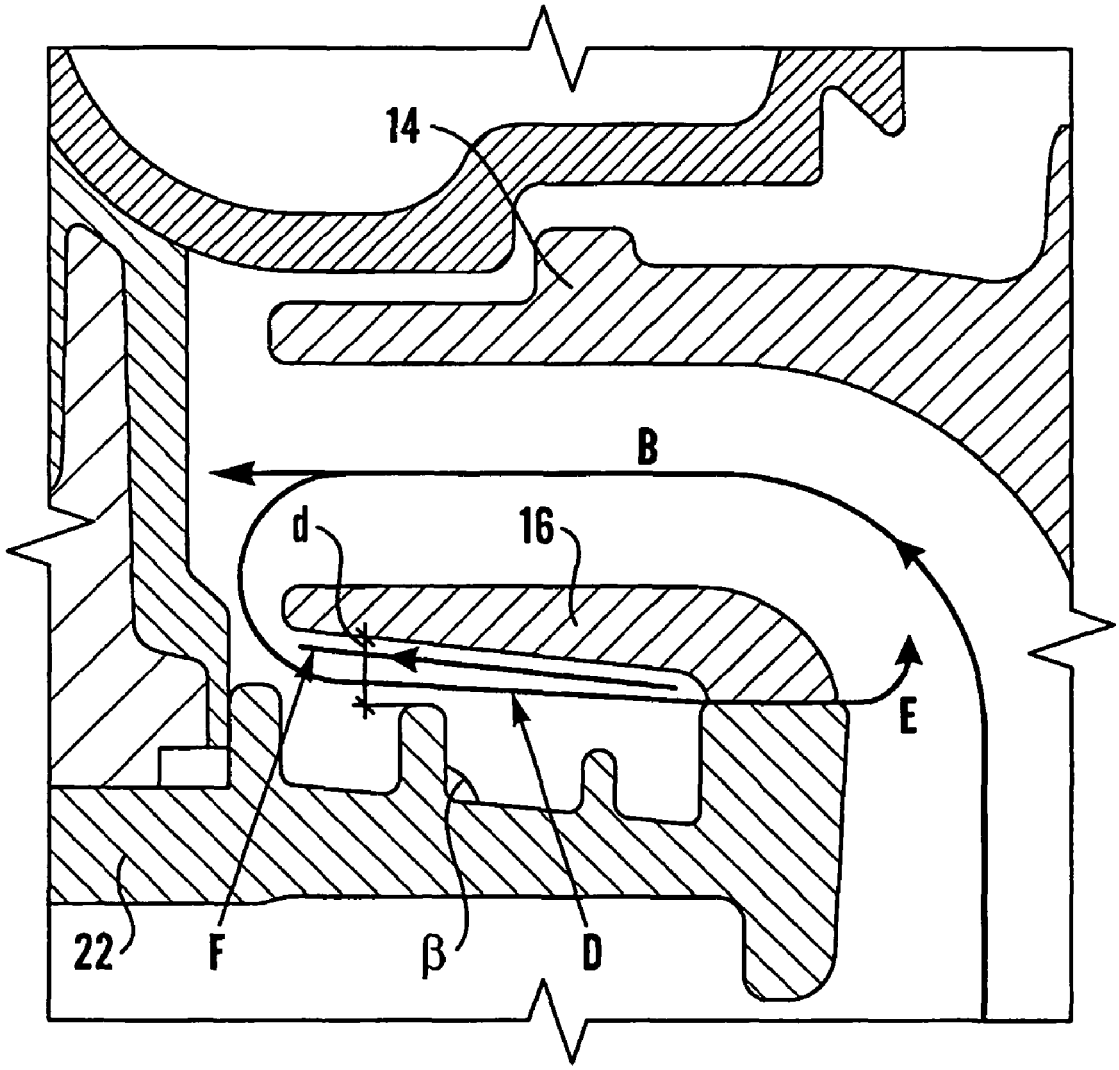
Figure 3:
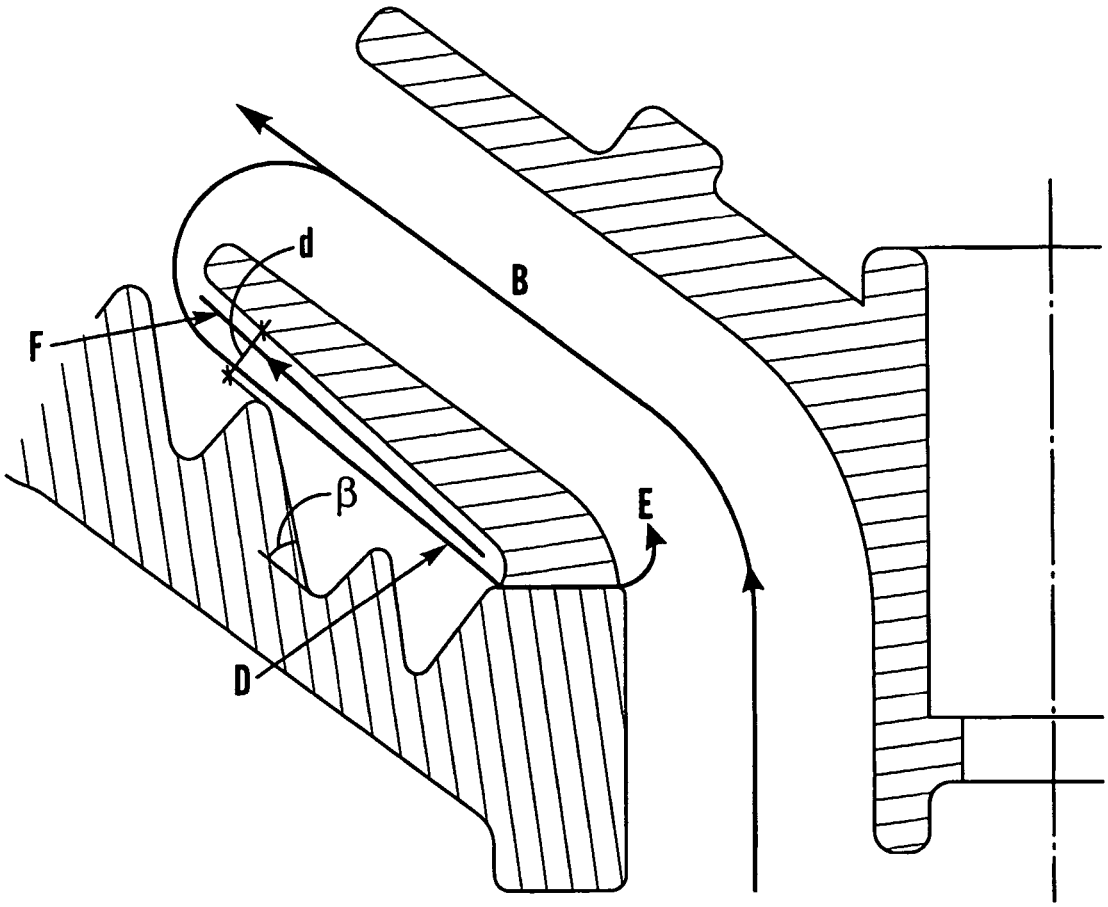
Figure 4:
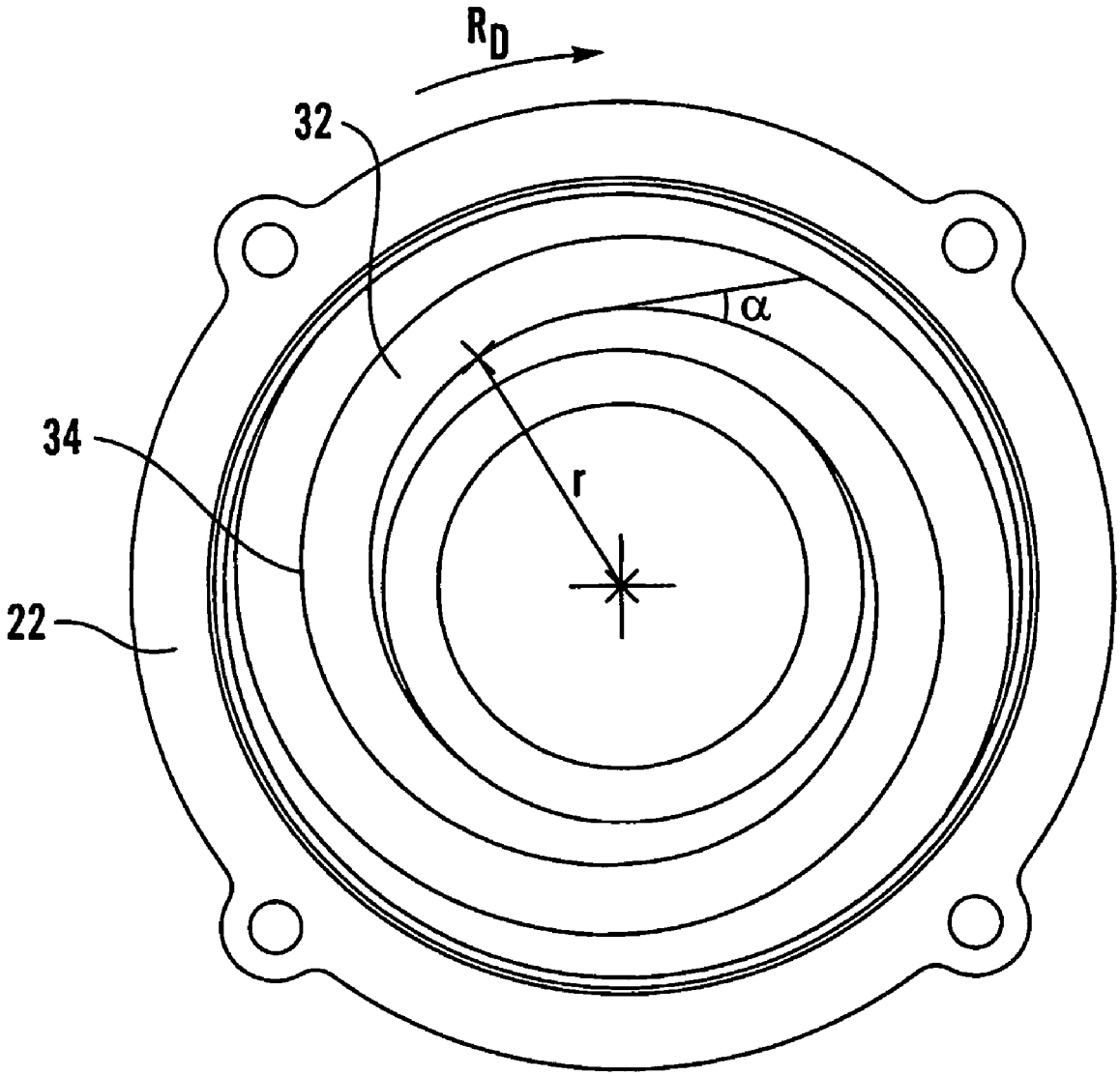

In the following detailed description of the invention, reference will be made to the accompanying drawings, of which FIG. 1 is an axial cross-section through a pump according to the invention, and FIG. 2 is a detail taken from the ring of FIG. 1, FIG. 3 is a modification of the detail of FIG. 2, and FIG. 4 is the bottom of the pump housing seen from above.

DETAILED DESCRIPTION OF THE INVENTION

The pump shown in FIG. 1 comprises a drive shaft 10 connected to an electrical motor (not shown) for driving the pump. To the lower end of the shaft a pump impeller 12 is mounted, comprising upper 14 and lower 16 cover discs, vanes 18 and back vanes 19. The above mentioned components are mounted in a pump housing 20, having a bottom wall 22, an inlet 24 and an outlet 26. The pump impeller 12 is mounted such in the pump housing that there is a gap 28 between the peripheral surface of the lower cover disc 16 and an inner side wall of the pump housing 20, a space 29 between the lower disc and the bottom wall as well as a gap 30 between a lower surface of the lower cover disc 16 and an upper surface of the bottom wall 22.

According to the principles for a centrifugal pump, the liquid is sucked in axially through the inlet 24 and leaves the pump through the outlet 26 according to flow arrows A, B and C. Because the pressure is much higher at the outlet than at the inlet, however a certain flow D will always flow back through the gap 28 and into the space 29 between the lower cover disc 16 and the bottom 22 of the pump housing. A part of this flow E passes the gap 30 back to the inlet, while a part of the flow F is again led outwards on the underside of the cover disc 16, so called boundary layer flow. A boundary layer flow is also present along the bottom wall, but directed inwards.

The back flow D creates losses and also results in that pollution, abrasive particles and the like, are gathered under the cover disc because particles of a certain size cannot pass the gap 30. This gathering of particles will then wear against pump impeller as well as against the bottom of the pump housing during running of the pump. Particles entering the gap 30 will act as grinders, with heavy wear on the surfaces of the gap. This may in a short time mean a considerable deterioration of the pump capacity because the gap is worn larger.

In order to ascertain a feeding of abrasive particles that have entered the space 29 between the lower cover disc and the bottom wall out towards the periphery for further transport towards the pump outlet, the bottom wall of the pump housing facing the lower surface of the lower cover disc of the impeller is arranged with one or several swept flow affecting means, in the embodiment shown spiral grooves 32 divided by ridges 34. In the embodiment shown the grooves wind spirally around the inlet opening 24 several turns. The flow affecting means are swept such that the radial distance r from the centre is increased in the rotational direction $R_d$ of the impeller, as seen in FIG. 4.

The grooves will affect the main flow D and the particles contained in the flow such that the water volume entering the space is moved in a tangential direction, due to the rotation of the impeller, and where the water volume is moved along the swept flow affecting means. This action causes the particles in the water to be moved in the grooves between the ridges in the rotational direction and due to the swept, and preferably spiral, shape of the grooves the pollutions will be fed along the grooves and out through the outlet, or at least be prevented from gathering in the gap. Because of the present invention the radial component of the boundary layer flow along the bottom wall is affected such that it is directed more in the tangential direction, thus also affecting the part of the water volume in the bottom of the grooves to be moved in the direction of the swept back flow affecting means.

During tests there are certain aspects that seem to affect the process in the gap and to what extent the water volume in the grooves are affected. For example the distance d, FIG. 2, between the lower surface of the lower cover disc and the top surfaces of the ridges between the grooves seem to have an influence. Tests have shown a good result of the process when the distance d is in the range of ⅓ to ⅔ of the distance between the bottom of the grooves and the lower surface of the lower cover disc, but this is not to be regarded as limiting to the invention. For example the distance could be smaller if the tolerances of the impeller wheel and the bottom wall where to be tighter, or if the bottom wall, or at least the ridges, where made of a resilient material such as rubber, which would allow some contact between the parts during use. The depth of the grooves and the distance between ridges in the radial direction, thus the volume in the grooves, has to be taken into account so that preferably the whole water volume is affected by the process.

The sweeping angle α of the spiral ridges also have an influence in affecting the direction of the flow and the feeding of particles in the grooves. It should in principle be possible to have straight edges of the flow affecting means with an angle to the radial direction, even though this design is not optimal for transporting particles towards the periphery of the impeller wheel.

The back surfaces of the ridges also affect the process and tests have shown that an angle β between the back surface and a plane parallel with the bottom of the pump housing should preferably be in the range 85 to 95 degrees, FIG. 2. For some types of impeller wheels however, such as those having a conical shape, and a corresponding shape to the bottom wall, FIG. 3, this range is not obtainable, at least not with cast metal bottom wall. Tests have however shown a satisfactory result with a design according to FIG. 3. If the bottom wall according to FIG. 3, or at least the flow affecting means, where to be made of a resilient material the ridges could be cast with an angle according to the above range.

With the right design of the ridge and groove a separating effect is obtained that leads to fewer and smaller particles in comparison with the rest of the liquid, in turn meaning a reduced wear. In view of the above the flow affecting means could either be grooves machined or cast in the bottom plate, or ridges attached to or cast in the bottom plate. Depending on the design of the bottom plate the ridges or grooves may have different design. The bottom plate shown in the drawings is made with integral back flow affecting means, but of course the back flow affecting means could be made as a separate part which is attached in a suitable way to the bottom wall. In order to increase the effect the lower cover disc may be arranged with back vanes turned towards the bottom wall containing the grooves/ridges. Such back vanes however constitute a certain energy loss and are therefore used only under especially difficult conditions.

It is to be understood that the embodiment described above and shown in the drawings is to be regarded as a non-limiting example of the invention and that it may be modified in many ways within the scope of the patent claims.

The invention claimed is:

1. A centrifugal pump for pumping liquids containing pollutions mainly in the form of solid particles, said pump comprising:

a drive unit, and a hydraulic unit, wherein the hydraulic unit comprises a pump housing (20) and a pump impeller (12) rotationally arranged inside the housing, the pump impeller comprising an upper (14) and a lower (16) cover disc and a number of intermediate vanes (18), the pump housing comprising a bottom wall (22) facing the lower cover disc and having a central inlet opening (24), wherein a circular gap (30) separates a space 29 arranged between the lower disc (16) and the bottom wall (22) from said central inlet opening (24), wherein the bottom wall (22) of the pump housing is arranged with at least one spirally swept, back flow affecting means (32, 34) on the side facing the lower cover disc (16) extending parts of or full turns around the inlet opening, and portions of said back flow affecting means (32, 34) and an upper surface of the bottom wall (22) being located adjacent the circular gap (30) are arranged below said circular gap (30).

2. The centrifugal pump according to claim 1, wherein the back flow affecting means is arranged as grooves (32) in the bottom wall.

3. The centrifugal pump according to claim 1, wherein the back flow affecting means is arranged as ridges (34) in the bottom wall.

4. The centrifugal pump according to any one of the preceding claims, wherein a wall part of the back flow affecting means facing towards the inlet forms an angle β with the plane of the bottom wall which is in the range 85 to 95 degrees.

* * * * *